US010934648B2

(12) United States Patent
Takahashi et al.

(10) Patent No.: US 10,934,648 B2
(45) Date of Patent: Mar. 2, 2021

(54) NEEDLE MOUNTING DEVICE AND SEWING MACHINE

(71) Applicant: BROTHER KOGYO KABUSHIKI KAISHA, Nagoya (JP)

(72) Inventors: Hideyuki Takahashi, Nagoya (JP); Masaki Yoshida, Nagoya (JP); Nobuhiko Funato, Gifu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 71 days.

(21) Appl. No.: 16/250,277

(22) Filed: Jan. 17, 2019

(65) Prior Publication Data

US 2019/0145035 A1 May 16, 2019

Related U.S. Application Data

(63) Continuation of application No. PCT/JP2017/019523, filed on May 25, 2017.

(30) Foreign Application Priority Data

Jul. 27, 2016 (JP) ..... JP2016-146882

(51) Int. Cl.
*D05B 55/02* (2006.01)

(52) U.S. Cl.
CPC ..... *D05B 55/02* (2013.01)

(58) Field of Classification Search
CPC ..... D05B 55/00; D05B 55/02; D05B 55/10; D04H 18/00; D05C 11/04
USPC ..... 112/220, 226, 221; 28/115
See application file for complete search history.

(56) References Cited

U.S. PATENT DOCUMENTS

| | | | | |
|---|---|---|---|---|
| 1,899,303 | A * | 2/1933 | Basso | D05B 55/02 112/221 |
| 3,277,854 | A * | 10/1966 | Casas-Robert | D05B 55/02 112/226 |
| 6,079,342 | A | 6/2000 | Tseng | |
| 7,096,807 | B1 | 8/2006 | Chang | |
| 2009/0020055 | A1 * | 1/2009 | Hillenbrand | D05B 55/02 112/226 |

(Continued)

FOREIGN PATENT DOCUMENTS

| | | |
|---|---|---|
| JP | 2004-222895 A | 8/2004 |
| JP | 2004-222896 A | 8/2004 |

(Continued)

OTHER PUBLICATIONS

Aug. 22, 2017 International Search Report issued in International Application No. PCT/JP2017/019523.

*Primary Examiner* — Alissa L Hoey
*Assistant Examiner* — Patrick J. Lynch
(74) *Attorney, Agent, or Firm* — Oliff PLC

(57) ABSTRACT

A needle mounting device mounts a punch needle for needle punching on a needle bar of a sewing machine. The needle mounting device includes an insertion portion, an engaging mechanism, and an affixing portion. The insertion portion has a bar shape and is configured to be inserted into a mounting portion provided in the needle bar for mounting a sewing needle. The engaging mechanism is able to engage with the needle bar at a different position from the insertion portion in an extension direction of the insertion portion. The affixing portion is configured to affix the punch needle.

14 Claims, 16 Drawing Sheets

(56) References Cited

U.S. PATENT DOCUMENTS

| | | | | |
|---|---|---|---|---|
| 2012/0000081 | A1 | 1/2012 | Kawaguchi et al. | |
| 2020/0190716 | A1* | 6/2020 | Sakuma ..... | D05B 55/02 |

FOREIGN PATENT DOCUMENTS

| | | | |
|---|---|---|---|
| JP | 3818380 | B2 | 9/2006 |
| JP | 2012-11683 | A | 1/2012 |

* cited by examiner

NEEDLE MOUNTING DEVICE AND SEWING MACHINE

CROSS-REFERENCE TO RELATED APPLICATION

This application is a Continuation Application of International Application No. PCT/JP2017/019523, filed May 25, 2017, which claims priority from Japanese Patent Application No. 2016-146882, filed on Jul. 27, 2016. This disclosure of the foregoing application is hereby incorporated by reference in its entirety.

BACKGROUND

The present disclosure relates to a needle mounting device for mounting a punch needle on a needle bar of a sewing machine, and to a sewing machine in which the needle mounting device is mounted on the needle bar.

A needle mounting device is known that mounts, on a needle bar of a sewing machine, a punch needle for needle punching. The needle mounting device includes a pair of clamping members that can be coupled by a plurality of screws. Each one of the clamping members includes a first clamping portion and a second clamping portion that, when in a coupled state, form a cylindrical hole. In a case where needle punching is performed on a work cloth by the sewing machine, the punch needle is mounted by the needle mounting device by the procedure hereinafter described. First, a sewing needle is removed from a needle holder. Next, the needle bar and the punch needle are disposed between the pair of the clamping members, which are in a decoupled state. The pair of the clamping members are coupled by the screws. The first clamping portion clamps the needle bar in a state in which the pair of the clamping members are positioned such that they are in contact with the top face of the needle holder. The second clamping portion clamps a needle holding portion of the punch needle. This enables needle punching to be performed by the sewing machine.

SUMMARY

In the case of the needle mounting device described above, the force that bears on the punch needle during needle punching acts, through the pair of the clamping members, on the portion of the needle bar that is clamped by the first clamping portion. That is, the force that bears on the punch needle acts in a concentrated manner on a portion of needle bar. Therefore, during needle punching, there is a possibility that the position of the needle mounting device will shift in relation to the needle bar, depending on how the needle is mounted.

Various embodiments of the general principles described herein provide a needle mounting device that is able to mount a punch needle securely on a needle bar, as well as a sewing machine in which the needle mounting device is mounted on the needle bar.

Various embodiments herein provide a needle mounting device for mounting a punch needle for needle punching on a needle bar of a sewing machine. The needle mounting device includes an insertion portion, an engaging mechanism, and an affixing portion. The insertion portion has a bar shape and is configured to be inserted into a mounting portion provided in the needle bar for mounting a sewing needle. The engaging mechanism is able to engage with the needle bar at a different position from the insertion portion in an extension direction of the insertion portion. The affixing portion is configured to affix the punch needle.

Embodiments also provide a sewing machine including a needle bar and a needle mounting device for mounting a punch needle for needle punching on the needle bar. The needle mounting device includes an insertion portion, an engaging mechanism, and an affixing portion. The insertion portion has a bar shape and is configured to be inserted into a mounting portion provided in the needle bar for mounting a sewing needle. The engaging mechanism is able to engage with the needle bar at a different position from the insertion portion in an extension direction of the insertion portion. The affixing portion is configured to affix the punch needle.

BRIEF DESCRIPTION OF THE DRAWINGS

Embodiments of the disclosure will be described below in detail with reference to the accompanying drawings in which.

DETAILED DESCRIPTION

An embodiment of the present disclosure will be explained with reference to the drawings. A sewing machine 1 is capable of performing needle punching when punch needles 9 are mounted on a needle bar 16A by a needle mounting device 2. Needle punching is a processing method in which a decorative pattern is formed in a cloth by repeatedly causing the punch needles 9 to pierce the cloth. In the explanation that follows, the top side, the bottom side, the left side, the right side, the lower right side, and the upper left side in FIG. 1 respectively define the top side, the bottom side, the left side, the right side, the front side, and the rear side of the sewing machine 1 and the needle mounting device 2.

Sewing Machine 1

Figure 1:
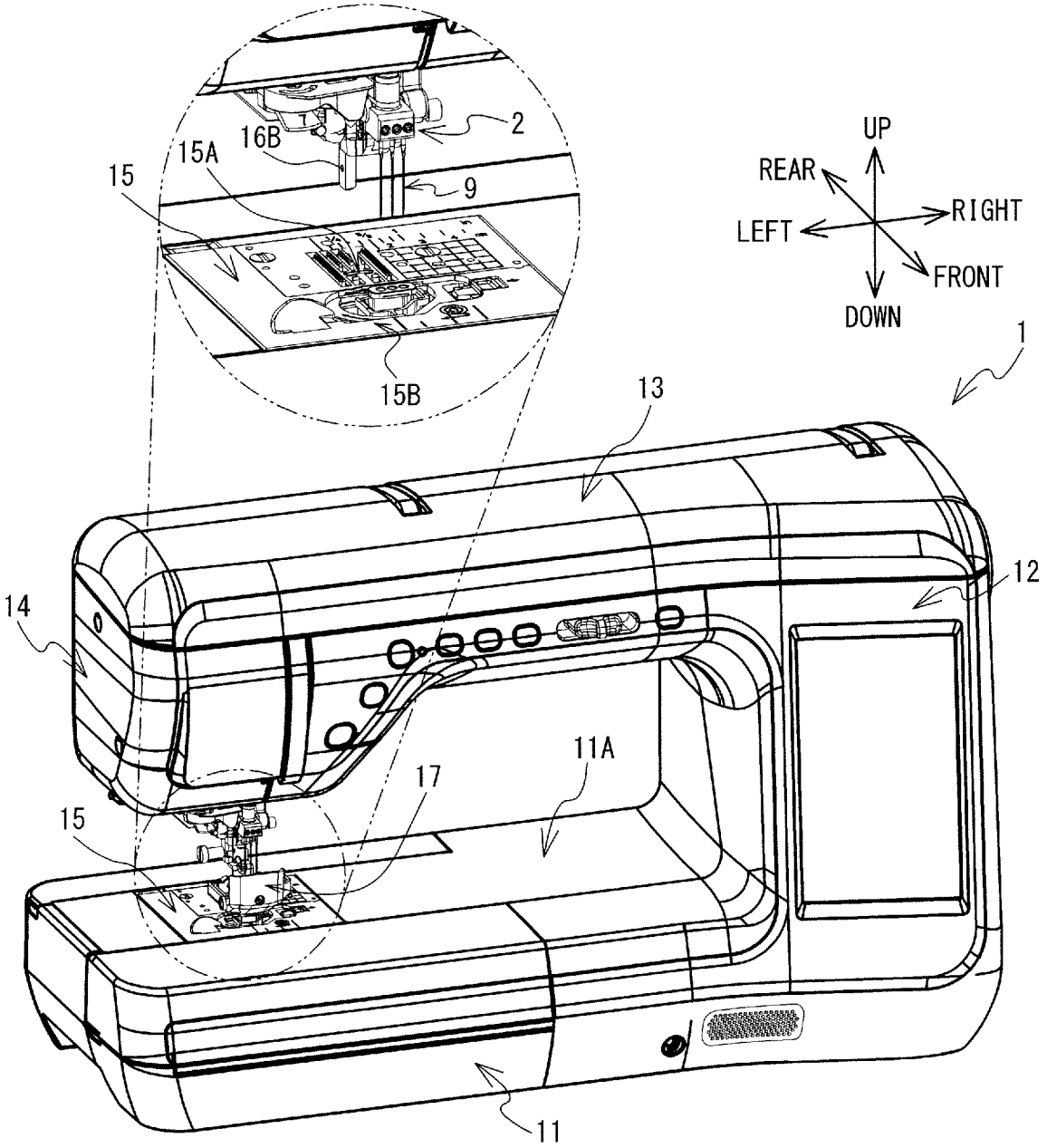
FIG. 1 is an oblique view of a sewing machine.

The configuration of the sewing machine 1 will be explained with reference to FIG. 1. The sewing machine 1 is mainly provided with a bed 11, a pillar 12, and an arm 13. The bed 11 is a base portion of the sewing machine 1 and extends in the left-right direction. The pillar 12 extends upward from the right end portion of the bed 11. The arm 13 extends to the left from the top of the pillar 12 such that it is opposite the bed 11. The left end portion of the arm 13 is a head 14.

The needle bar 16A (refer to FIG. 2) and a presser bar 16B are provided on the bottom face of the head 14. The needle bar 16A extends downward from the bottom face of the head 14. During ordinary sewing, a sewing needle (not shown in the drawings) is mounted on a mounting portion 161 (refer to FIG. 2) on the lower end of the needle bar 16A by a needle holding bar of a needle holder 18 (refer to FIG. 2). During needle punching, instead of the sewing needle being mounted on the needle bar 16A, the needle mounting device 2 is mounted on the needle bar 16A. Cloth pressers that are mounted on the presser bar 16B are different for ordinary sewing and needle punching. FIG. 1 shows a state in which a cloth presser 17 for needle punching is mounted. The cloth presser 17 has been omitted from the enlarged drawing in FIG. 1.

A rectangular needle plate 15 is provided on a top face 11A of the bed 11. The needle plate 15 is located directly below the head 14. The needle plate 15 includes needle holes 15A, 15B, which extend vertically through the needle plate 15. A shuttle mechanism (not shown in the drawings) is provided in the interior of the bed 11, below the needle hole 15A. A dust box (not shown in the drawings) is provided in the interior of the bed 11, below the needle hole 15B. A sewing machine motor (not shown in the drawings) that is provided inside the pillar 12 rotationally drives a drive shaft (not shown in the drawings) that is provided inside the arm 13. The drive shaft transmits the driving force of the sewing machine motor to a needle bar up-down drive mechanism (not shown in the drawings) that is provided inside the head 14. The needle bar up-down drive mechanism moves the needle bar 16A up and down in conjunction with the rotation of the drive shaft.

During ordinary sewing, the tip of the sewing needle (not shown in the drawings) that is mounted on the needle bar 16A is inserted through the needle hole 15A in conjunction with the up-down movement of the needle bar 16A. The shuttle mechanism, operating in coordination with the sewing needle, forms stitches in a work cloth. During needle punching, the tips of the punch needles 9 that are affixed to the needle mounting device 2 are inserted through the needle hole 15B in conjunction with the up-down movement of the needle bar 16A. The dust box collects fiber waste that is generated during needle punching.

Needle Mounting Device 2

Figure 2:
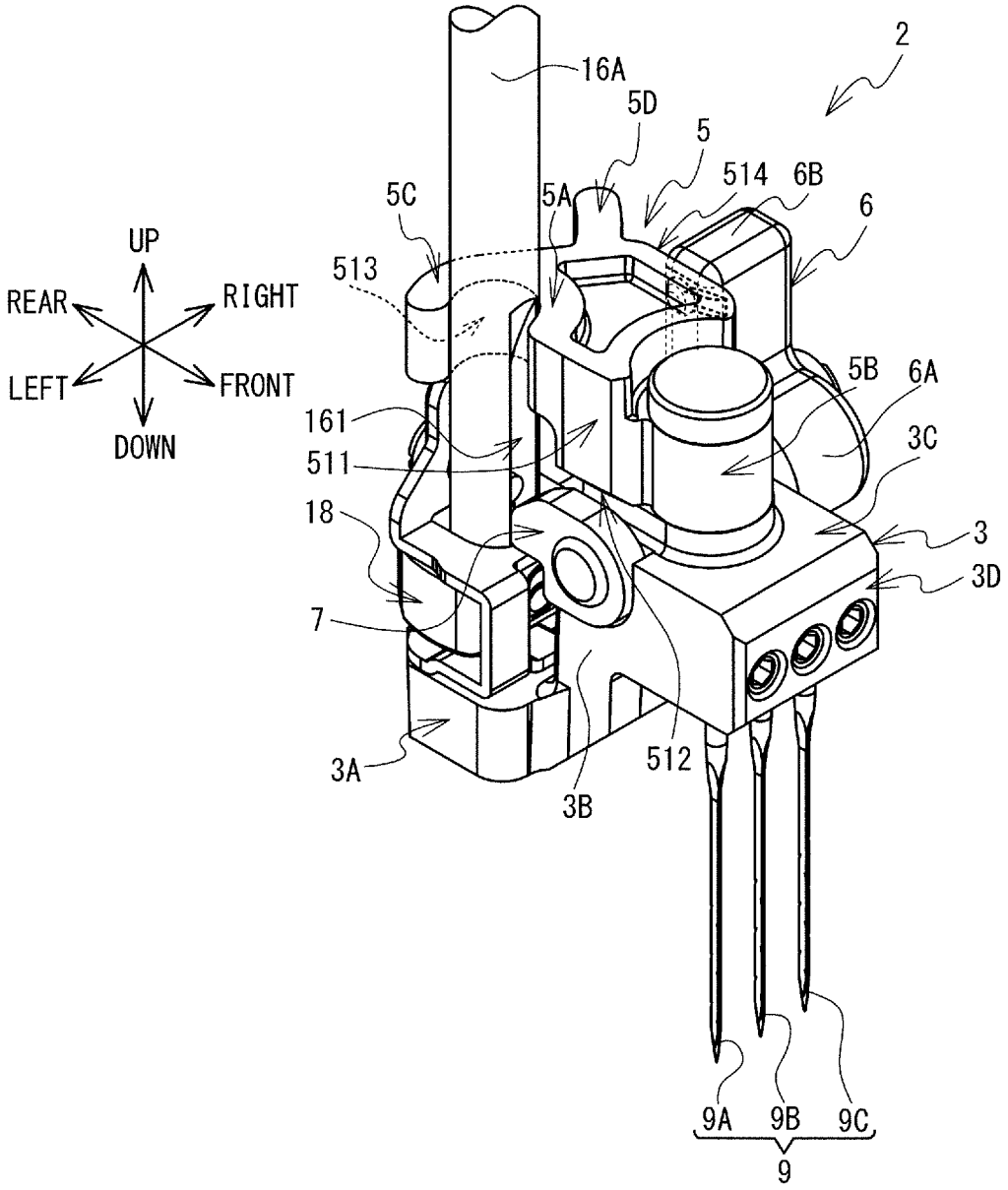
FIG. 2 is an oblique view of a needle mounting device (with an engaging lever in a second position)

As shown in FIG. 2, the needle mounting device 2 is removably mounted on the lower end of the needle bar 16A. The needle mounting device 2 is provided with a base portion 3, an insertion portion 4 (refer to FIG. 3), an engaging mechanism 5, an engaging lever 6, a cam 7, and the punch needles 9. Note that the engaging mechanism 5 rotates around a shaft that extends in the up-down direction, as will be described in detail later. The engaging mechanism 5 switches between a state in which it is engaged with the needle bar 16A (refer to FIG. 2) and a state in which it is disengaged from the needle bar 16A (refer to FIG. 3). Hereinafter, any position in which the engaging mechanism 5 is engaged with the needle bar 16A (refer to FIG. 2) will be called an engaged position. Any position in which the engaging mechanism 5 is disengaged from the needle bar 16A (refer to FIG. 3, for example) will be called a disengaged position. The engaging lever 6 is able to rotate around a shaft that extends in the left-right direction. The position of the engaging lever 6 when it has rotated as far as possible in the counterclockwise direction (refer to FIG. 3), as seen from the right side, will be called the first position. The position of the engaging lever 6 when it has rotated as far as possible in the clockwise direction (refer to FIG. 2), as seen from the right side, will be called the second position.

Base Portion 3

Figure 4:
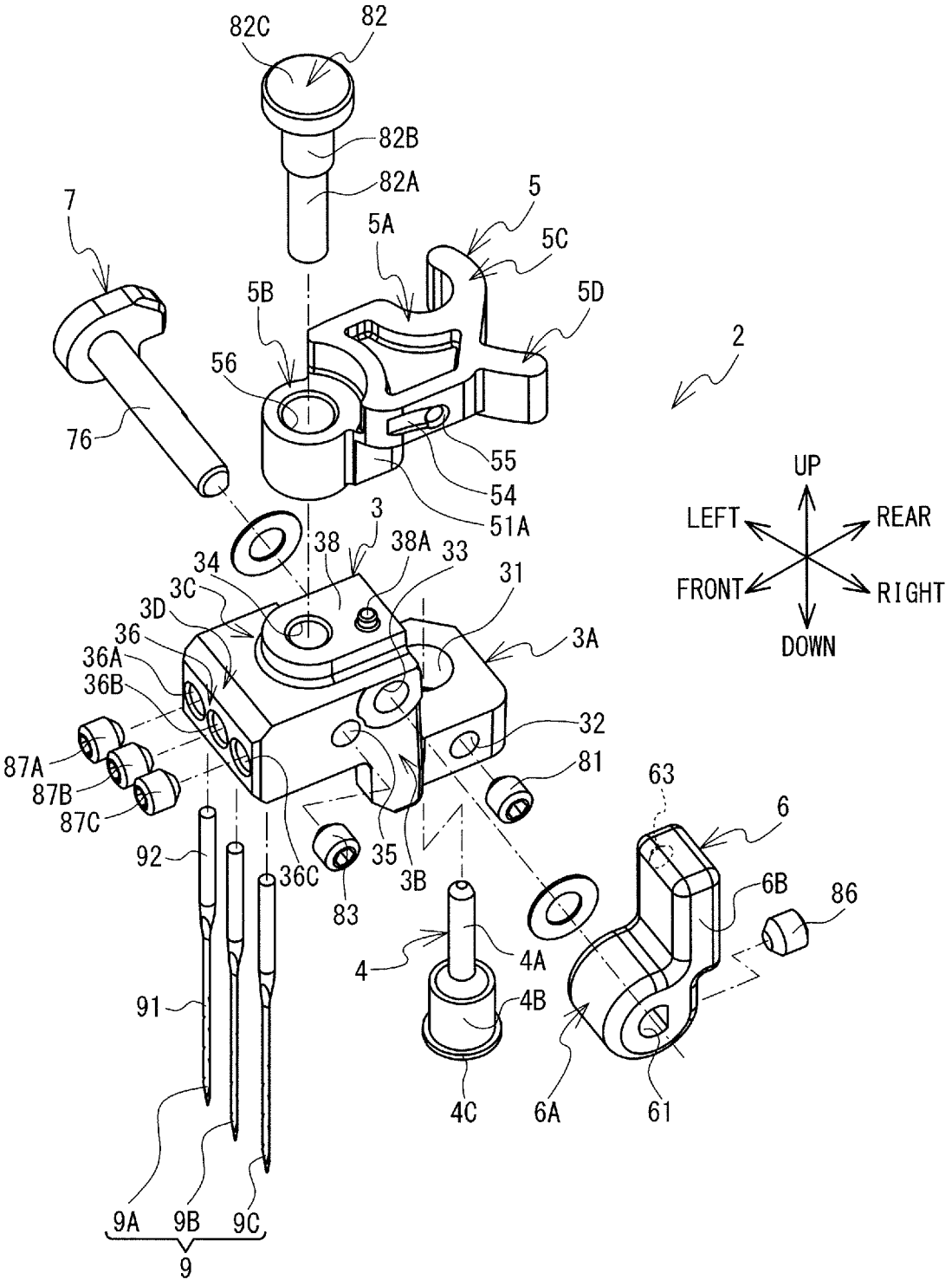
FIG. 4 is an exploded oblique view of the needle mounting device.
Figure 5:
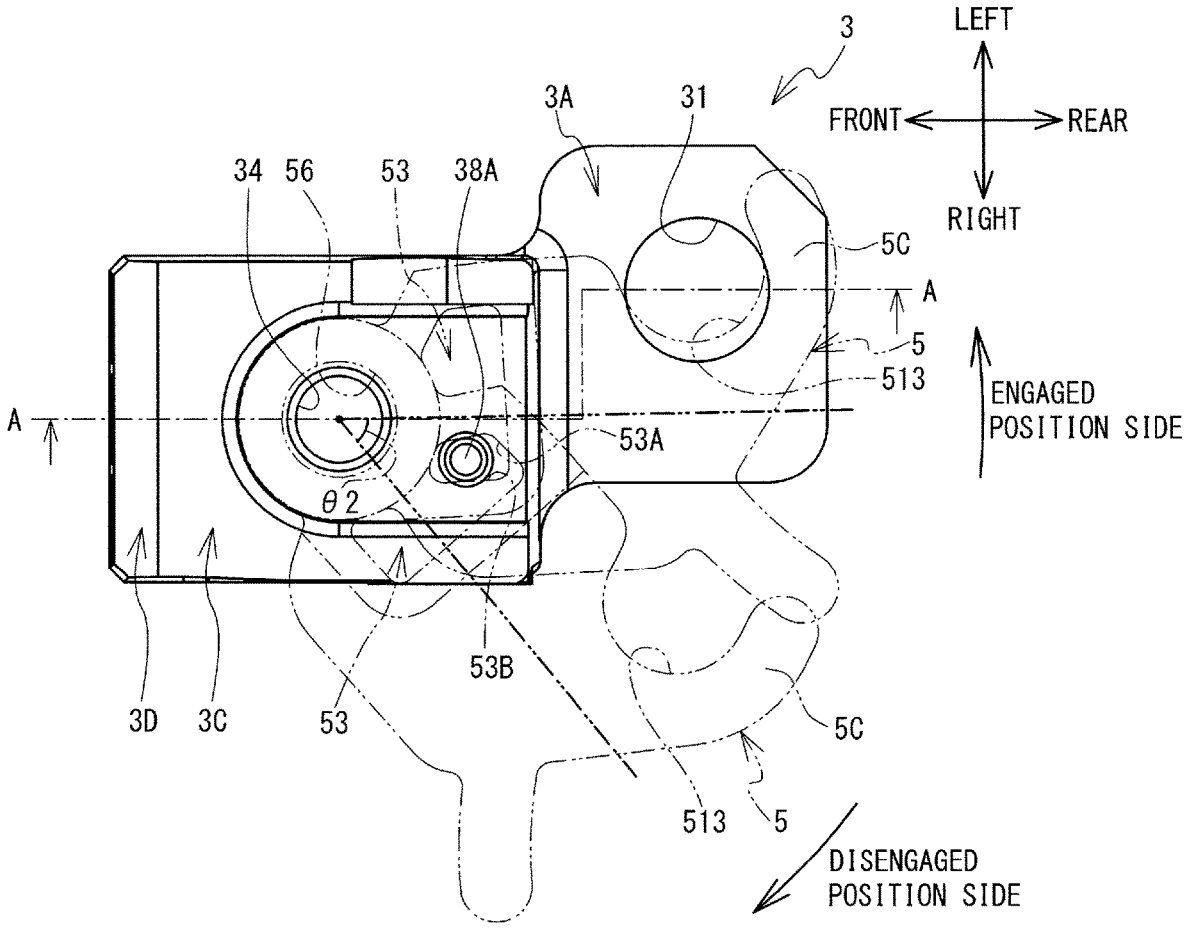
FIG. 5 is a plan view of a base portion and an engaging mechanism.

As shown in FIG. 4, the base portion 3 includes a foundation portion 3A, a connecting portion 3B, a body portion 3C, and an affixing portion 3D. The foundation portion 3A has a rectangular box shape. The connecting portion 3B extends upward from the front edge of the foundation portion 3A. The body portion 3C extends toward the front from the top edge of the connecting portion 3B. A projecting portion 38 that projects upward is provided on the top face of the body portion 3C. A protuberance 38A is provided on the top face of the projecting portion 38, near the rear edge and to the right of the center of the top face. The protuberance 38A protrudes upward. The affixing portion 3D is provided on the front edge of the body portion 3C. As shown in FIG. 5, the right edges of the body portion 3C and the affixing portion 3D are each positioned farther to the right than is the right edge of the foundation portion 3A. The left edge of the foundation portion 3A is positioned farther to the left than are the left edges of the body portion 3C and the affixing portion 3D. Therefore, the positions of the centers of the body portion 3C and the affixing portion 3D in the left-right direction are not aligned with the position of the center of the foundation portion 3A in the left-right direction.

Figure 6:
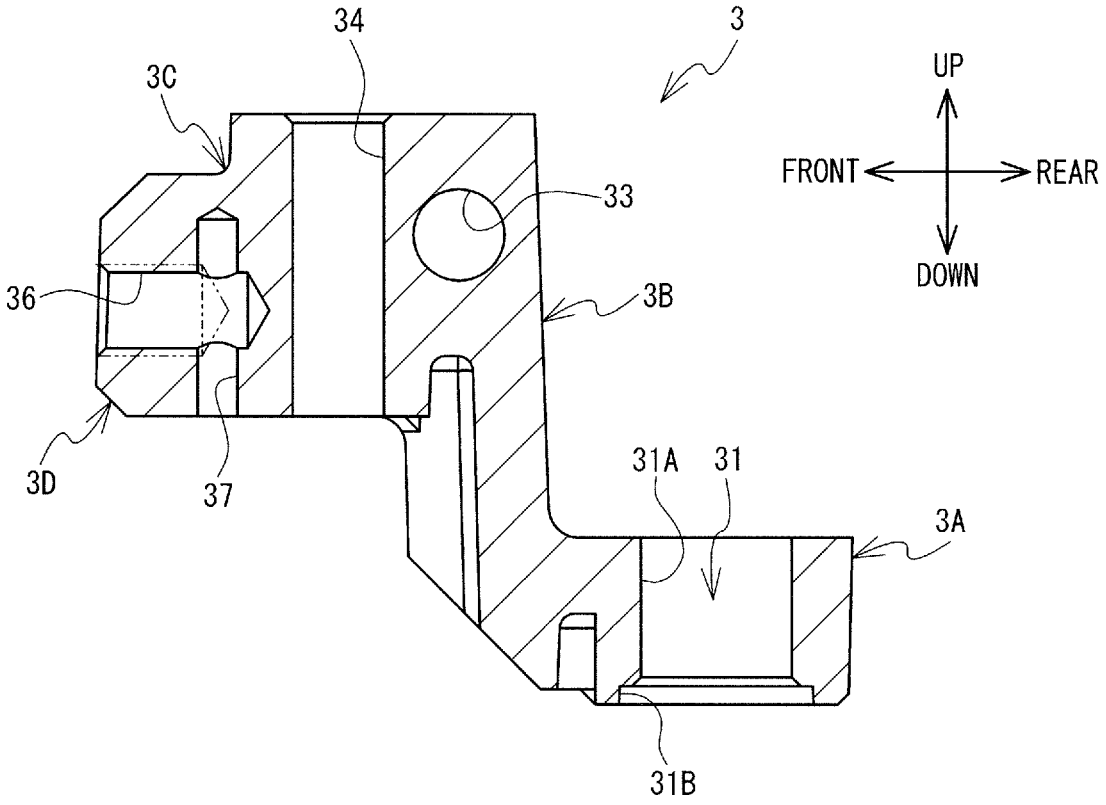
FIG. 6 is a section view as seen from the direction of arrows on a line A-A in FIG. 5.

As shown in FIG. 4, round holes 31, 32 are formed in the foundation portion 3A. The hole 31 extends through the foundation portion 3A in the up-down direction. As shown in FIG. 6, the hole 31 includes a first portion 31A and a second portion 31B, which have different diameters. The second portion 31B is disposed below the first portion 31A. The diameter of the second portion 31B is greater than the diameter of the first portion 31A. As shown in FIG. 4, the hole 32 extends toward the left from the right side face of the foundation portion 3A. The hole 32 is a threaded hole. The left end of the hole 32 is continuous with the hole 31.

Round holes 33, 34, 35 are formed in the body portion 3C. The hole 33 extends through the body portion 3C in the left-right direction, close to the rear edge. The hole 34 extends through the body portion 3C in the up-down direction. The opening at the upper end of the hole 34 is formed in the top face of the projecting portion 38. As shown in FIG. 5, the center of the hole 34 is located farther to the right than is the center of the hole 31 in the foundation portion 3A. As shown in FIG. 4, the hole 35 extends toward the left from the right side face of the body portion 3C. The hole 35 is a threaded hole. The left end of the hole 35 is continuous with the hole 34.

Round holes 36 (36A, 36B, 36C) and three holes 37 (refer to FIG. 6) are formed in the affixing portion 3D. The holes 36A, 36B, 36C each extend toward the rear from the front face of the affixing portion 3D. The holes 36A, 36B, 36C are arrayed in order from left to right. The holes 36 are threaded holes. The three holes 37 respectively correspond to the holes 36A, 36B, 36C. As shown in FIG. 6, the three holes 37 each extend upward from the bottom face of the affixing portion 3D. The holes 36 are continuous with the corresponding holes 37. The rear ends of the holes 36 extend to the rear of the corresponding holes 37.

Insertion Portion 4

Figure 7:
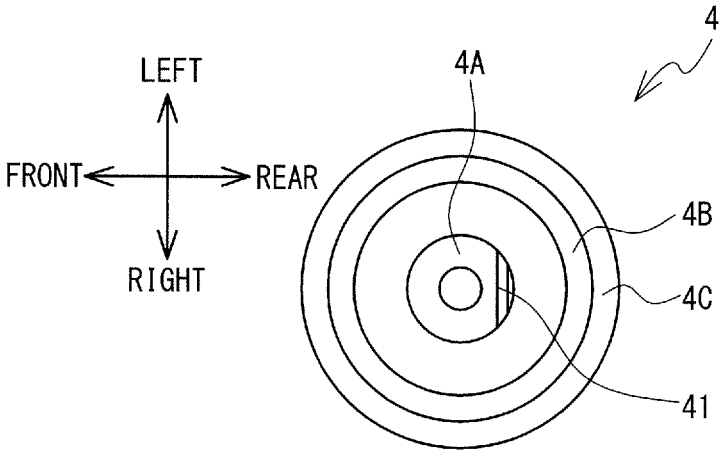
FIG. 7 is a plan view of an insertion portion.

As shown in FIG. 4, the insertion portion 4 includes cylindrical portions 4A, 4B, 4C. The cylindrical portions 4A, 4B, 4C each have a substantially cylindrical shape. The cylindrical portions 4A, 4B, 4C are arrayed in order from top to bottom. The axes of the cylindrical portions 4A, 4B, 4C each extend in the up-down direction. The diameter of the cylindrical portion 4C is slightly smaller than the diameter of the second portion 31B (refer to FIG. 6) of the hole 31 in the foundation portion 3A and is greater than the diameter of the first portion 31A (refer to FIG. 6) of the hole 31 in the foundation portion 3A. The diameter of the cylindrical portion 4B is slightly smaller than the diameter of the first portion 31A (refer to FIG. 6) of the hole 31 in the foundation portion 3A. The diameter of the cylindrical portion 4A is smaller than the diameters of the cylindrical portions 4B, 4C. As shown in FIG. 7, a portion of the circumferential face of the cylindrical portion 4A has been cut away to form a flat surface. The cylindrical portion 4A includes a flat portion 41 on its rear side. The flat portion 41 is formed along a plane that is parallel to an extension direction (the up-down direction) of the cylindrical portion 4A.

Figure 3:
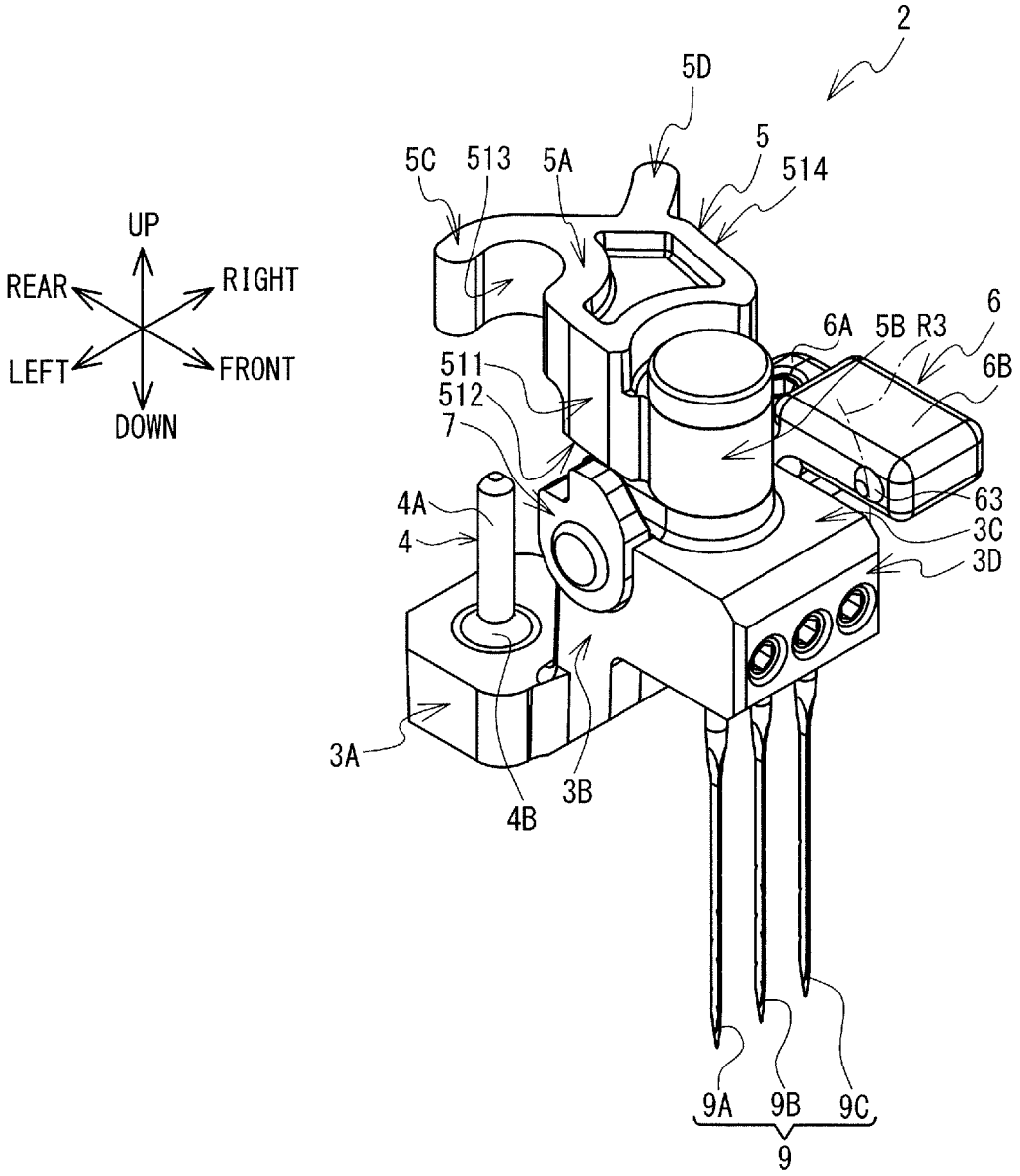
FIG. 3 is an oblique view of the needle mounting device (with the engaging lever in a first position)

As shown in FIG. 4, the insertion portion 4 is inserted from below into the hole 31 of the foundation portion 3A of the base portion 3. As shown in FIG. 3, the cylindrical portion 4A of the insertion portion 4 protrudes upward above the top face of the foundation portion 3A. The position of the insertion portion 4 in the up-down direction is determined by bringing the upper edge of the cylindrical portion 4C of the insertion portion 4 into contact, from below, with the boundary between the first portion 31A and the second portion 31B of the foundation portion 3A. As described above, the diameter of the cylindrical portion 4C of the insertion portion 4 is slightly smaller than the diameter of the second portion 31B of the hole 31 of the foundation portion 3A. Furthermore, the diameter of the cylindrical portion 4B of the insertion portion 4 is slightly smaller than the diameter of the first portion 31A (refer to FIG. 6) of the hole 31 of the foundation portion 3A. Therefore, the insertion portion 4 is able to slide in relation to the hole 31 of the foundation portion 3A. The insertion portion 4 is supported such that it can rotate in relation to the foundation portion 3A around an axis that extends in the extension direction. The position of the upper end of the insertion portion 4 in the up-down direction is set so as to be lower than the top face of the body portion 3C of the base portion 3. As shown in FIG. 4, a set screw 81 is threaded into the hole 32 of the foundation portion 3A. The tip of the set screw 81 is able to come into contact, from the right side, with the cylindrical portion 4B of the insertion portion 4 in the interior of the hole 31. The set screw 81 is able to restrict the rotation of the insertion portion 4. With the flat portion 41 facing the rear, the rotation of the insertion portion 4 is restricted, such that the insertion portion 4 is affixed to the foundation portion 3A. The direction in which the flat portion 41 of the insertion portion 4 faces the base portion 3 (the foundation portion 3A, the connecting portion 3B, the body portion 3C, the affixing portion 3D) can be adjusted by the set screw 81.

Engaging Mechanism 5

In the explanation of the engaging mechanism 5 that follows, the individual directions (up, down, left, right, front, and rear) with respect to the engaging mechanism 5 when it is in an engaged position (refer to FIG. 2) are referenced, except where otherwise specified. Note that the explanation of the rotation direction of the engaging mechanism 5 assumes that the engaging mechanism 5 is being viewed from above. As shown in FIG. 4, the engaging mechanism 5 is provided with a base portion 5A and extension portions 5B, 5C, 5D.

Figure 8:
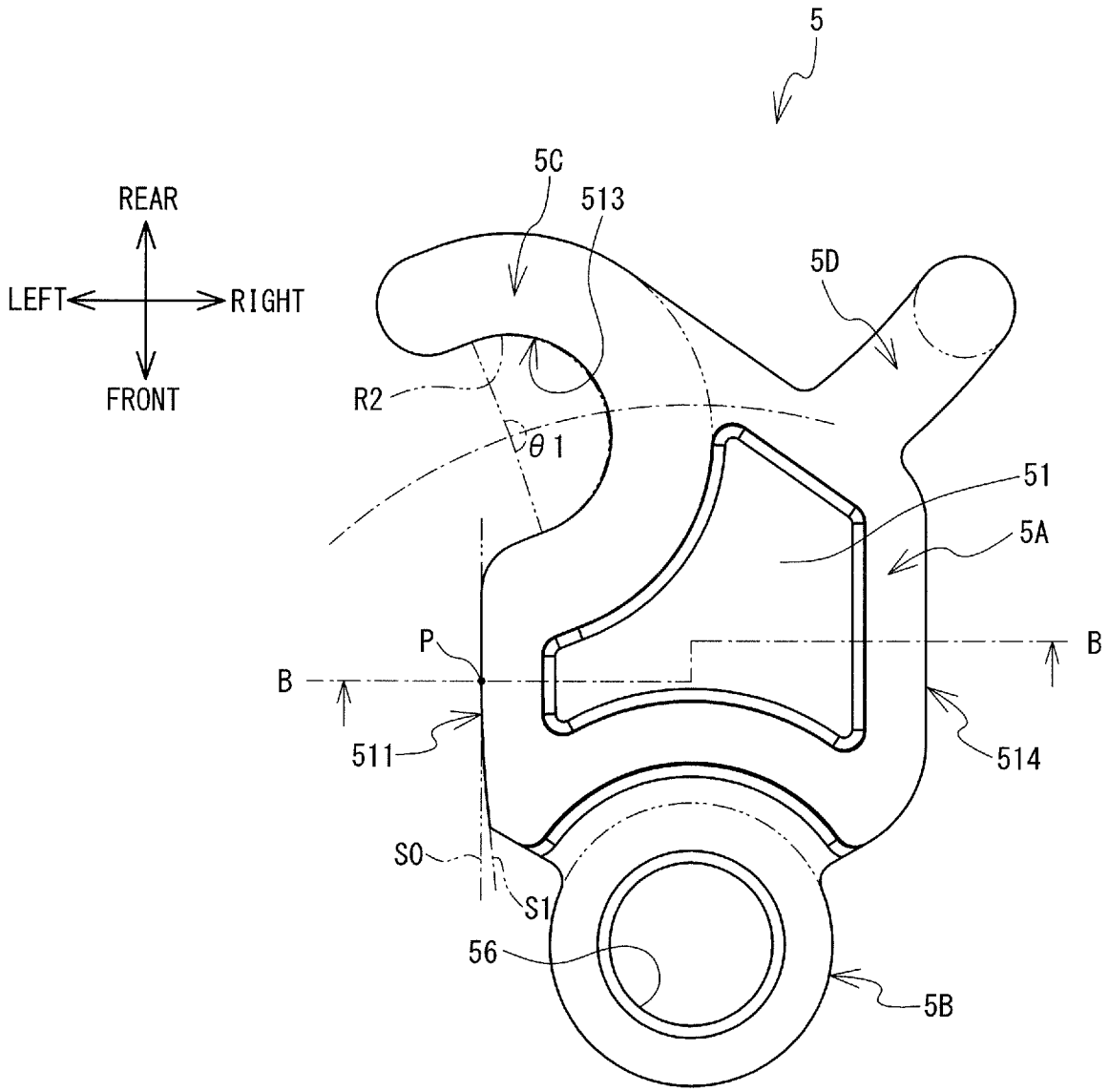
FIG. 8 is a plan view of the engaging mechanism.

The base portion 5A is a substantially plate-shaped member whose thickness is defined as being in the up-down direction. The part of the bottom face of the base portion 5A that is near the front edge projects downward (refer to FIGS. 9, 10). Hereinafter, the projecting portion will be called the projecting portion 51A. As shown in FIG. 8, a side face 511 is formed on the left side of the base portion 5A. A portion P is defined as being substantially in the center between the front and rear edges of the side face 511. The portion of the side face 511 that is to the rear of the portion P extends along a plane that is orthogonal to the left-right direction. In contrast, the portion of the side face 511 that is toward the front from the portion P is curved in relation to the plane that is orthogonal to the left-right direction. Assume, for example, that virtual planes are defined that are tangent to the portions of the side face 511 that are to the rear of and toward the front from the portion P. In this case, a plane S0 that is tangent to the portion of the side face 511 that is to the rear of the portion P is orthogonal to the left-right direction. In contrast, a plane S1 that is tangent to the portion of the side face 511 that is toward the front from the portion P is oblique in relation to the plane S0. In other words, the plane S1 is oblique in relation to the left-right direction. As shown in FIG. 10, a beveled portion 512 is provided on the lower left corner of the projecting portion 51A. Assume, for example, that a virtual plane S2 is defined that extends along the beveled portion 512. In this case, the plane S2 is oblique in relation to the plane S0, which is orthogonal to the left-right direction. In other words, the plane S2 is oblique in relation to the left-right direction.

Figure 9:
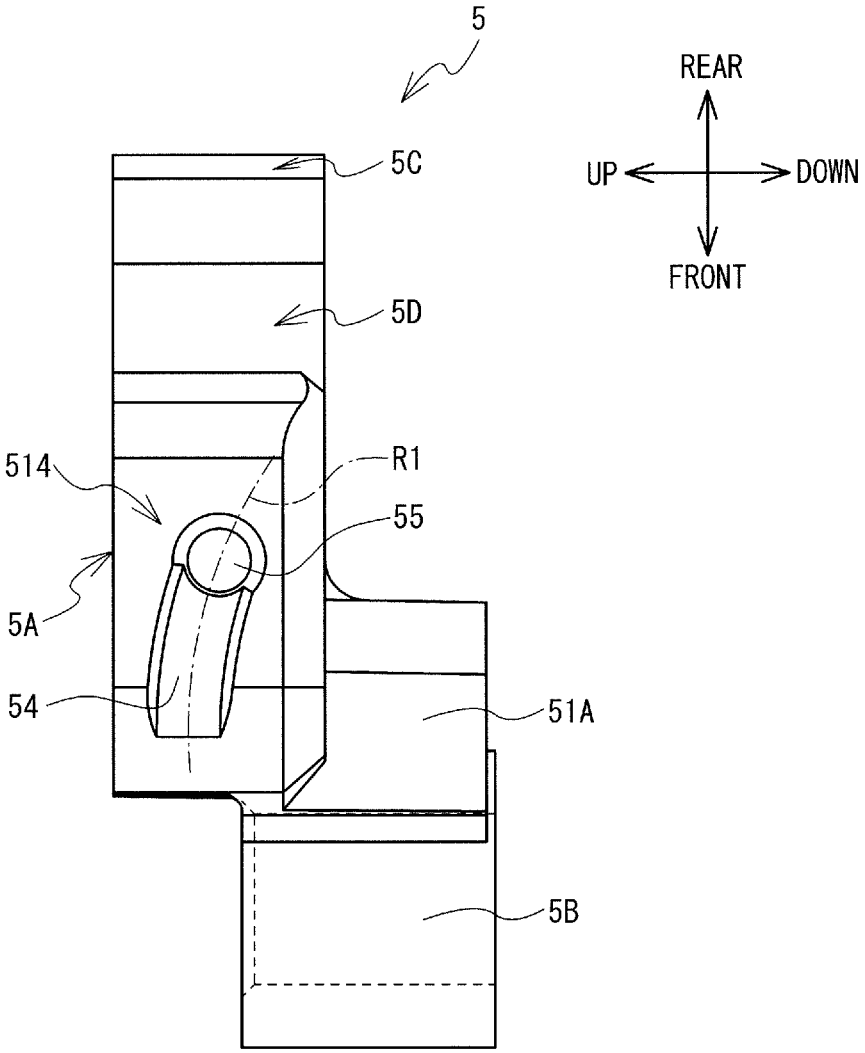
FIG. 9 is a right side view of the engaging mechanism.
Figure 10:
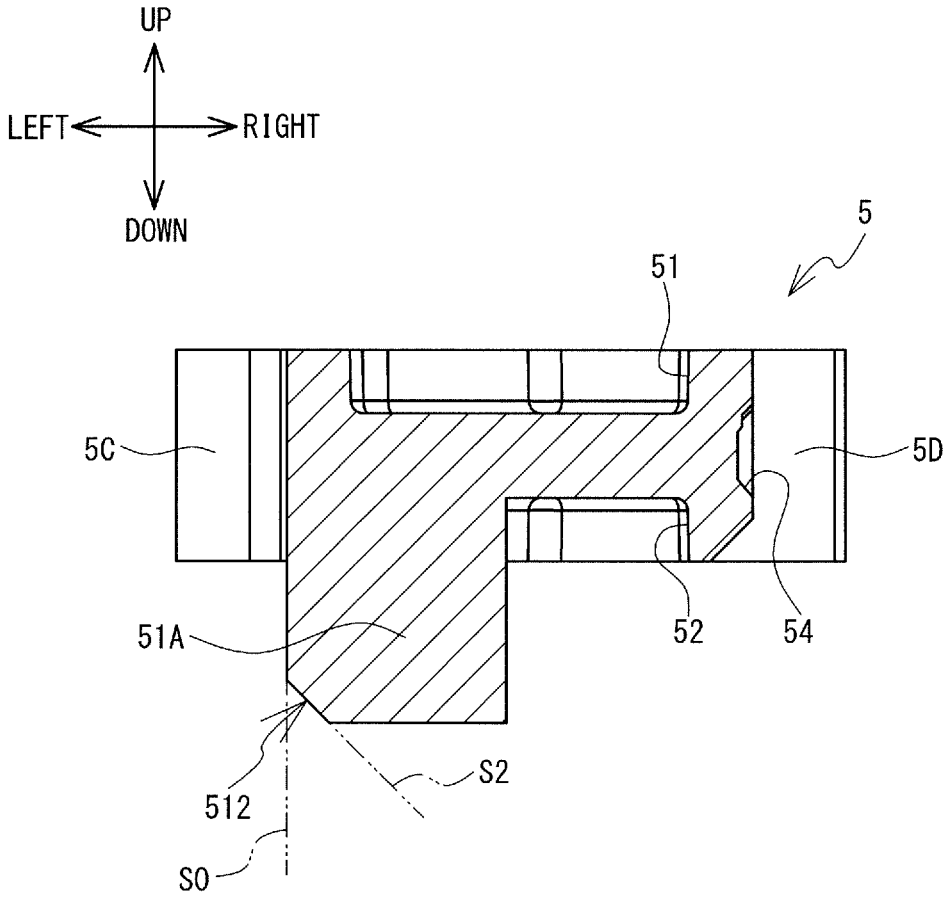
FIG. 10 is a section view as seen from the direction of arrows on a line B-B in FIG. 8.
Figure 11:
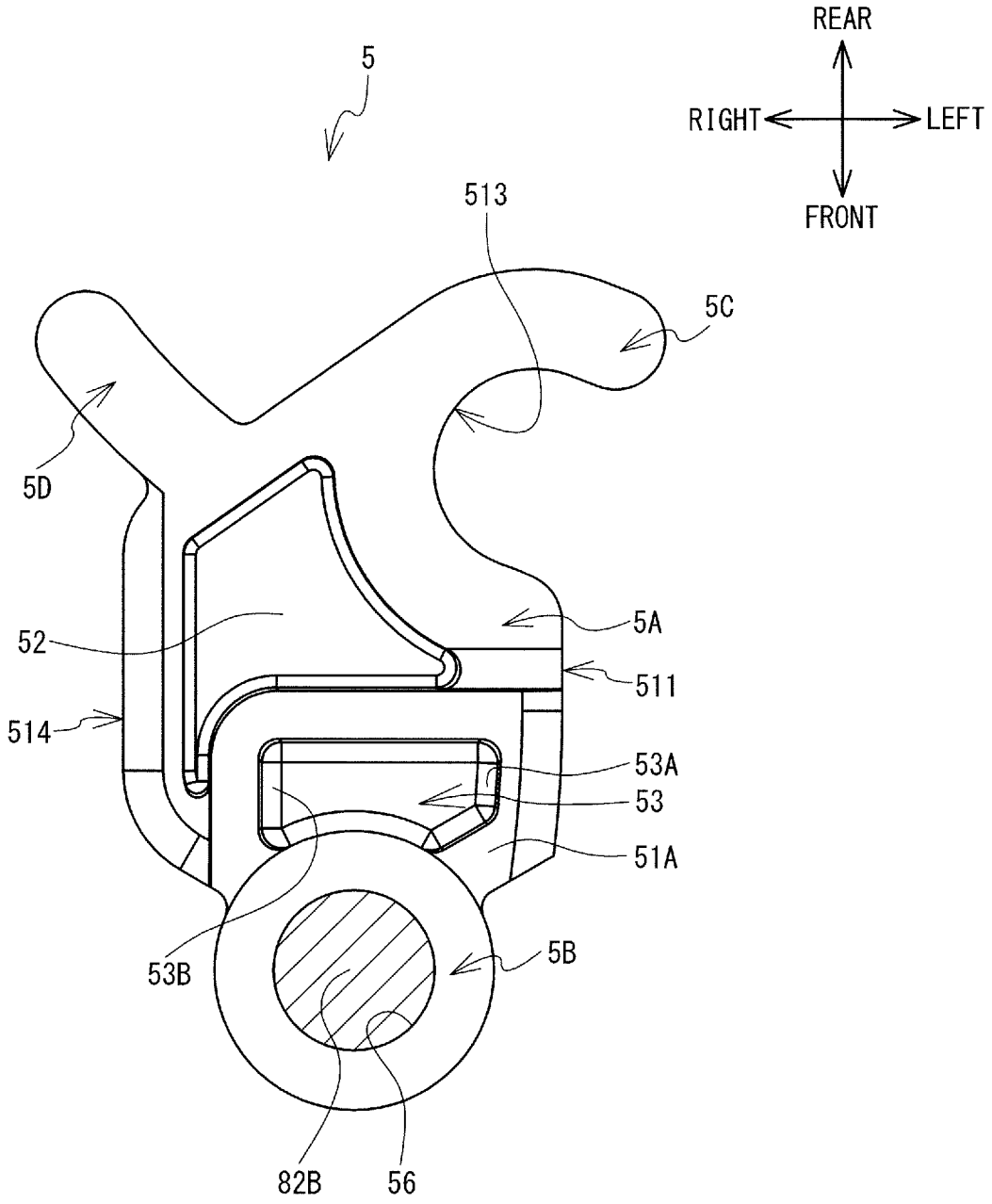
FIG. 11 is a rear view of the engaging mechanism.

The base portion 5A includes recessed portions 51 (refer to FIG. 8), 52 (refer to FIG. 11), 53 (refer to FIG. 11), 54 (refer to FIG. 9), and 55 (refer to FIG. 9). As shown in FIG. 8, the recessed portion 51 is provided on the top face of the base portion 5A. As shown in FIG. 11, the recessed portion 52 is provided on the bottom face of the base portion 5A, in the area that excludes the projecting portion 51A. The recessed portion 53 is provided on the bottom face of the projecting portion 51A of the base portion 5A. The recessed portion 53 extends in the left-right direction. Hereinafter, the edge on the left side of the recessed portion 53 will be called the left edge 53A, and the edge on the right side will be called the right edge 53B. As shown in FIG. 9, the recessed portions 54, 55 are provided on a side face 514 on the right side of the base portion 5A. The recessed portion 54 extends along an arc R1. The center of the arc R1 is located on the central axis of the hole 33 in the base portion 3 (refer to FIG. 4). The recessed portion 55 is located at the rear end of the recessed portion 54. The recessed portion 55 is round in a side view. The depth of the recessed portion 55 is greater than the depth of the recessed portion 54.

As shown in FIG. 9, the extension portion 5B is connected to the bottom face of the projecting portion 51A of the base portion 5A. As shown in FIG. 8, the extension portion 5B is cylindrical. The extension portion 5B includes a round hole 56 that extends through the extension portion 5B in the up-down direction. The diameter of the hole 56 is greater than the diameter of the hole 34 in the body portion 3C (refer to FIG. 4). The extension portion 5C extends in a curve toward the left side from a point on the rear edge of the base portion 5A that is substantially in the center of the left-right direction. The left side face of the extension portion 5C and the side face of the base portion 5A to the rear of the side face 511 (hereinafter called the engaging portion 513) form an arc R2. The diameter of the arc R2 is substantially the same as the diameter of the needle bar 16A (refer to FIG. 2). The central angle θ1 of the arc R2 is approximately 180 degrees. The extension portion 5D extends obliquely toward the right rear from a point on the right rear side of the base portion 5A.

As shown in FIG. 4, a shaft support portion 82 includes cylindrical portions 82A, 82B, 82C. The cylindrical portions 82A, 82B, 82C are each substantially cylindrical. The cylindrical portions 82A, 82B, 82C are arrayed in order from bottom to top. The axes of the cylindrical portions 82A, 82B, 82C each extend in the up-down direction. The diameter of the cylindrical portion 82A is slightly smaller than the diameter of the hole 34 in the body portion 3C. The diameter of the cylindrical portion 82B is slightly smaller than the diameter of the hole 56 in the extension portion 5B of the engaging mechanism 5. The diameter of the cylindrical portion 82C is greater than the diameters of the cylindrical portions 82A, 82B.

In a state in which the engaging mechanism 5 is disposed on top of the body portion 3C of the base portion 3, the shaft support portion 82 is inserted into the hole 56 of the engaging mechanism 5 and the hole 34 of the body portion 3C from above. The cylindrical portion 82A is disposed inside the hole 34, and the cylindrical portion 82B is disposed inside the hole 56. The position of the shaft support portion 82 in the up-down direction is determined by bringing the cylindrical portion 82C into contact, from above, with the top face of the extension portion 5B of the engaging mechanism 5. As described above, the diameter of the cylindrical portion 82B of the shaft support portion 82 is slightly smaller than the diameter of the hole 56 in the engaging mechanism 5. Therefore, the engaging mechanism 5 is able to slide in relation to the shaft support portion 82. The engaging mechanism 5 is supported such that it can rotate on the body portion 3C, with the shaft support portion 82 serving as the center of rotation. A set screw 83 is threaded into the hole 35 in the body portion 3C. In the interior of the hole 34, the tip of the set screw 83 is able to come into contact with the cylindrical portion 82A of the shaft support portion 82. The set screw 83 is able to restrict the shaft support portion 82 from shifting in relation to the body portion 3C.

As shown in FIG. 5, in a state in which the engaging mechanism 5 is supported by the body portion 3C, the protuberance 38A on the body portion 3C is fitted into the recessed portion 53 of the projecting portion 51A from below. The rotation of the engaging mechanism 5 in relation to the body portion 3C is restricted to the range within which the protuberance 38A can move inside the recessed portion 53. More specifically, the counterclockwise rotation of the engaging mechanism 5 is restricted by the protuberance 38A coming into contact with the right edge 53B of the recessed portion 53. The clockwise rotation of the engaging mechanism 5 is restricted by the protuberance 38A coming into contact with the left edge 53A of the recessed portion 53.

Hereinafter, the specified range of angles within which the engaging mechanism 5 can be rotated by the protuberance 38A and the recessed portion 53 will be called the angle range θ2. Counterclockwise rotation of the engaging mechanism 5 will be called rotation toward the engaged position side, and clockwise rotation will be called rotation toward the disengaged position side. Rotation toward the engaged position side causes the engaging mechanism 5 to engage with the needle bar 16A, and rotation toward the disengaged position side causes the engaging mechanism 5 to disengage from the needle bar 16A. In a state in which the protuberance 38A is in contact with the right edge 53B of the recessed portion 53, such that further rotation toward the engaged position side is restricted, the position of the engaging mechanism 5 is called the maximum engagement position. In a state in which the protuberance 38A is in contact with the left edge 53A of the recessed portion 53, such that further rotation toward the disengaged position side is restricted, the position of the engaging mechanism 5 is called the maximum disengagement position. Every position to which the engaging mechanism 5 moves within the angle range θ2 is one of an engaged position and a disengaged position.

Engaging Lever 6, Cam 7

In the explanation of the engaging lever 6 and the cam 7 that follows, the individual directions (up, down, left, right, front, and rear) with respect to the engaging lever 6 and the cam 7 when the engaging lever 6 is in the second position (refer to FIG. 2) are referenced, except where otherwise specified. Note that the explanation of the rotation directions of the engaging lever 6 and the cam 7 assumes that the engaging lever 6 and the cam 7 are being viewed from the right side.

Figure 12:
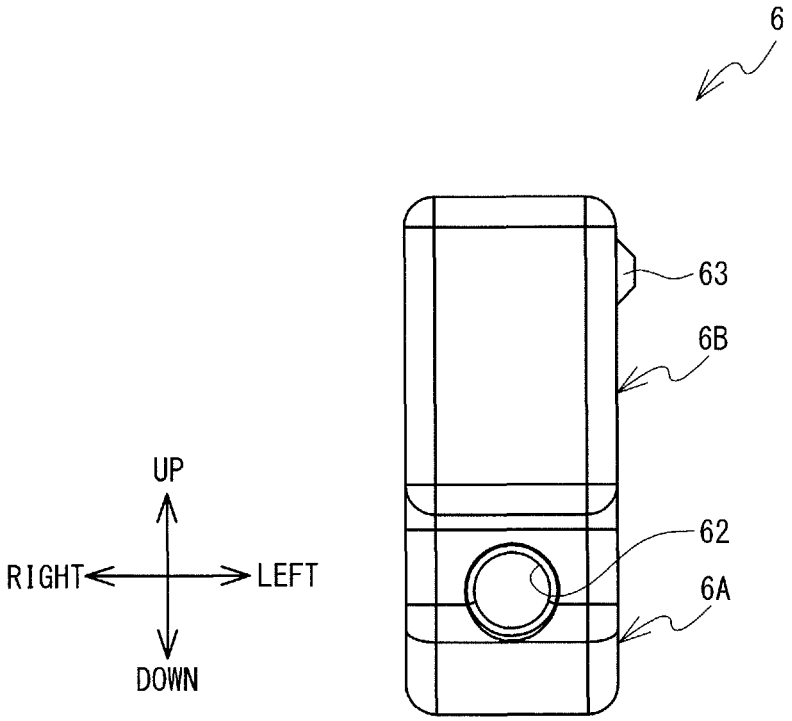
FIG. 12 is a rear view of the engaging lever.

As shown in FIG. 4, the engaging lever 6 includes a cylindrical portion 6A and an extension portion 6B. The cylindrical portion 6A has a cylindrical shape. The central axis of the cylindrical portion 6A extends in the left-right direction. A hole 61 is formed in the cylindrical portion 6A, extending through the cylindrical portion 6A in the left-right direction. A flat portion is formed on the rear side of the inner wall of the hole 61. As shown in FIG. 12, a hole 62 extends toward the front from the rear face of the cylindrical portion 6A. The hole 62 is a threaded hole. The leading end of the hole 62 is continuous with the hole 61. As shown in FIG. 4, the extension portion 6B is a plate-shaped component that extends from the outer wall of the cylindrical portion 6A. As shown in FIG. 3, a protuberance 63 is provided on the left side face of the extension portion 6B, close to the tip of the extension portion 6B. The protuberance 63 protrudes toward the left. The diameter of an arc R3 that passes through the protuberance 63 and is centered on the central axis of the hole 61 (refer to FIG. 3) is substantially the same as the diameter of the arc R1 (refer to FIG. 9).

Figure 13:
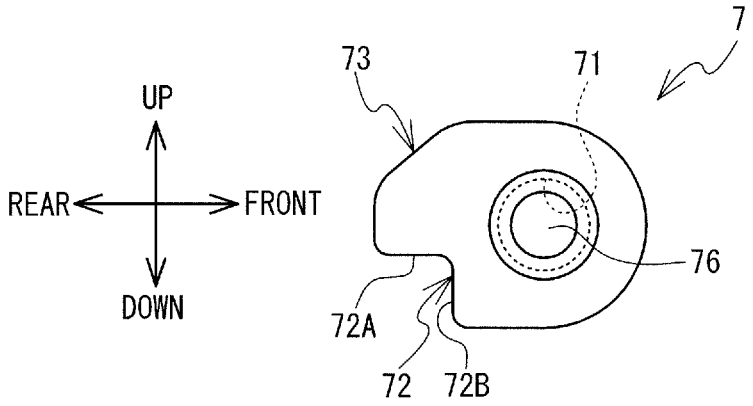
FIG. 13 is a left side view of a cam.

As shown in FIG. 13, the cam 7 is an eccentric cam that has a substantially elliptical shape in a side view. A round hole 71 is formed in the cam 7, extending through the cam 7 in the left-right direction. The center of the hole 71 is located toward the front from the center of gravity of the cam 7. The cam 7 is provided with a notch 72 and a beveled portion 73. The notch 72 is formed by two straight sides 72A, 72B. The side 72A extends toward the front from the rear edge of the cam 7. The side 72B extends upward from the bottom edge of the cam 7. The front end of the side 72A and the upper end of the side 72B are connected to each other. The beveled portion 73 extends in a straight line upward and toward the front from the rear edge of the cam 7.

As shown in FIG. 4, the left end of a substantially cylindrical shaft 76 is fitted into the hole 71 of the cam 7. The shaft 76 extends toward the right from the cam 7. A portion on the rear side of the circumferential face of the shaft 76 near the right end has been cut away to form a flat surface. The shaft 76 is inserted from the left side through the hole 33 in the body portion 3C of the base portion 3. The right end of the shaft 76 protrudes to the right from the right edge of the body portion 3C and is fitted into the hole 61 in the engaging lever 6. The flat portion in the hole 61 and the flat portion on the shaft 76 are in contact with one another. The rotation of the shaft 76 in relation to the engaging lever 6 is thus restricted. Therefore, the shaft 76 rotates in coordination with the rotation of the engaging lever 6, and the cam 7 that is provided on the left end of the shaft 76 rotates. A set screw 86 is threaded into the hole 62 in the engaging lever 6 (refer to FIG. 12). In the interior of hole 61, the tip of the set screw 86 is able to come into contact, from the rear, with the flat portion of the shaft 76. The set screw 86 is able to restrict the shaft 76 from shifting in relation to the engaging lever 6.

As shown in FIG. 2, when the engaging lever 6 is disposed in the second position, the extension portion 6B extends vertically upward from the cylindrical portion 6A. The extension portion 6B is disposed on the right side of the side face 514 of the engaging mechanism 5. In this case, the protuberance 63 on the extension portion 6B (refer to FIG. 3) engages with the recessed portion 55 of the engaging mechanism 5 (refer to FIG. 9). The rotation of the engaging mechanism 5 toward a disengaged position is thus restricted. In other words, the rotation of the engaging mechanism 5 toward a disengaged position is restricted by the engaging lever 6 before the engaging mechanism 5 reaches the maximum disengagement position.

When the engaging lever 6 is disposed in the second position, a portion of the cam 7 projects farther to the rear than the rear edge of the body portion 3C of the base portion 3. The side 72A of the notch 72 of the cam 7 (refer to FIG. 13) extends horizontally, such that it faces downward toward the foundation portion 3A of the base portion 3.

As shown in FIG. 3, when the engaging lever 6 is disposed in the first position, the extension portion 6B extends horizontally toward the front from the cylindrical portion 6A. The protuberance 63 on the extension portion 6B disengages from the recessed portions 54, 55 of the engaging mechanism 5. A portion of the cam 7 projects farther upward than the top face of the projecting portion 38 of the body portion 3C of the base portion 3. In this case, the side face 511 of the engaging mechanism 5 comes into contact with the cam 7 from the right side, such that the engaging mechanism 5 is prevented from rotating any farther toward the engaged position side than the maximum engagement position (refer to FIG. 5). In other words, the rotation of the engaging mechanism 5 toward the engaged position side is restricted by the cam 7 before the engaging mechanism 5 reaches the maximum engaged position.

Punch Needles 9

As shown in FIG. 4, the punch needles 9 (9A, 9B, 9C) each include a needle body portion 91 and a needle holding portion 92. A plurality of barbs are formed in the needle body portion 91. The needle holding portion 92 is located above the needle body portion 91. The needle holding portions 92 of the punch needles 9 are inserted into the holes 37 in the affixing portion 3D of the base portion 3 from below (refer to FIG. 6). Set screws 87A, 87B, 87C are threaded into the holes 36A, 36B, 36C in the affixing portion 3D. In the interiors of the holes 37, the tips of the respective set screws 87A, 87B, 87C are able to come into contact, from the front, with the needle holding portions 92 of the corresponding punch needles 9A, 9B, 9C. The set screws 87A, 87B, 87C are thus able to affix the punch needles 9A, 9B, 9C to the affixing portion 3D. In the state in which the needle holding portions 92 are affixed to the affixing portion 3D, the needle body portions 91 of the punch needles 9 extend downward from the affixing portion 3D.

Mounting Operation of the Needle Mounting Device 2

The engaging mechanism 5 of the needle mounting device 2 is disposed in the maximum disengagement position, and the engaging lever 6 is disposed in the first position. The insertion portion 4 of the needle mounting device 2 is inserted into the mounting portion 161 of the needle bar 16A from below. Note that when the engaging lever 6 is disposed in the first position, the cam 7 does not project farther to the rear than the rear edge of the body portion 3C of the base portion 3 (refer to FIG. 3). Therefore, the cam 7 does not interfere when the insertion portion 4 is inserted into the needle bar 16A.

A flat positioning portion (not shown in the drawings) that faces toward the front is provided in the interior of the mounting portion 161. The insertion portion 4 is inserted into the mounting portion 161 with the flat portion 41 (refer to FIG. 7) oriented such that it fits tightly against the positioning portion. The flat portion 41 of the insertion portion 4 faces toward the rear. The punch needles 9 that are affixed to the affixing portion 3D of the base portion 3 are disposed farther to the front than the needle bar 16A. Inside the mounting portion 161, the insertion portion 4 is held in place by the needle holding bar of the needle holder 18.

Figure 14:
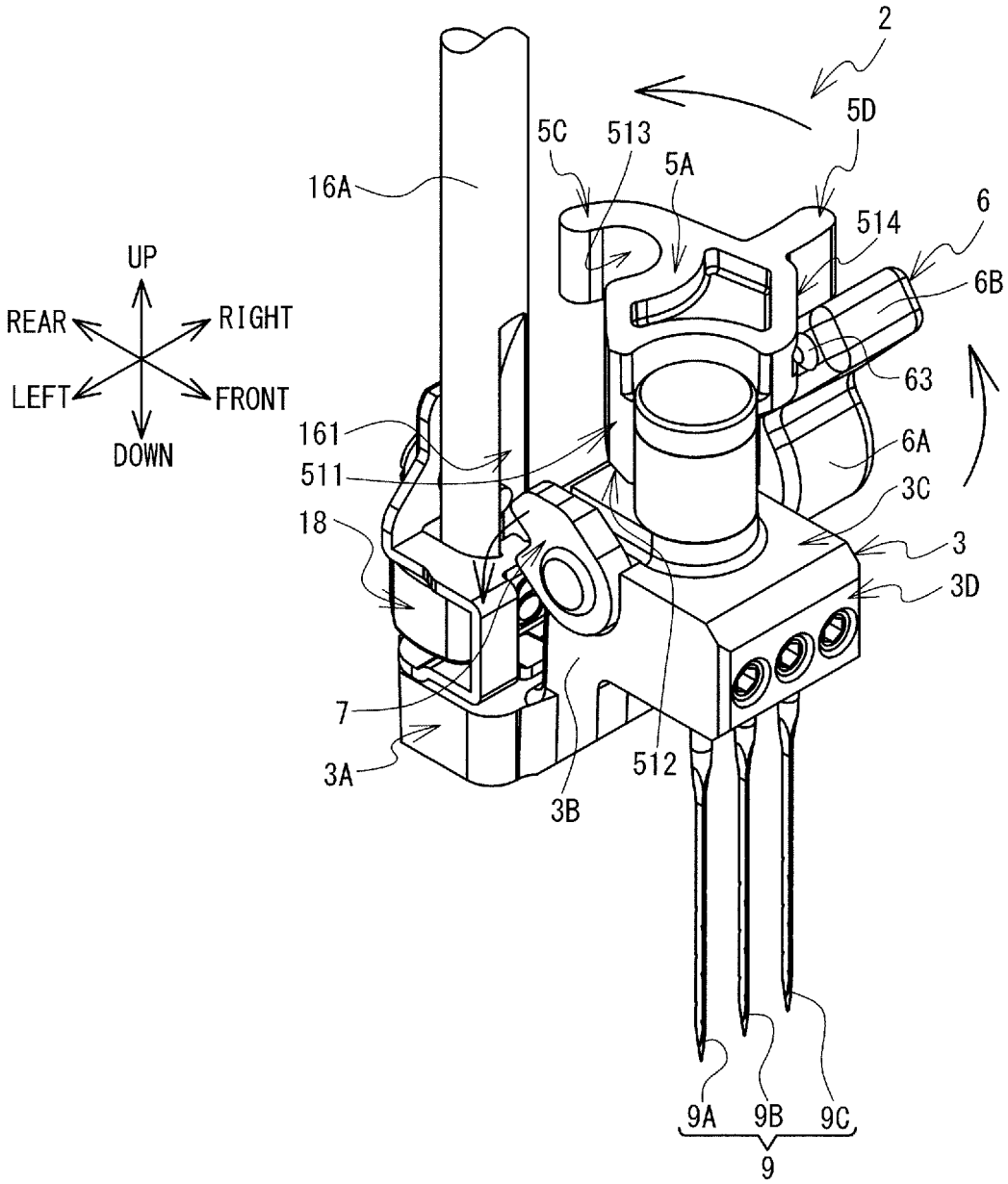
FIG. 14 is an oblique view of the needle mounting device (with the engaging lever between the first position and the second position)

The engaging lever 6 is rotated from the first position toward the second position. As shown in FIG. 14, the protuberance 63 of the extension portion 6B of the engaging lever 6 comes into contact with the recessed portion 54 that is provided in the side face 514 of the engaging mechanism 5 (refer to FIG. 9). The center position of the arc R1 that extends along the recessed portion 54 (refer to FIG. 9) is congruent with the center position of the arc R3 that follows the movement path of the protuberance 63 (refer to FIG. 3), and the radii of the arc R1 and the arc R3 are substantially the same. Therefore, in the process by which the engaging lever 6 rotates from the first position toward the second position, the protuberance 63 moves along the recessed portion 54 toward the recessed portion 55 (refer to FIG. 9). The engaging lever 6 comes into contact with the engaging mechanism 5 from the right side and pushes it toward the left, thus causing the engaging mechanism 5 to rotate from a disengaged position toward the engaged position side.

As the engaging lever 6 rotates, the protuberance 63 moves toward the recessed portion 55 and engages with the recessed portion 55. As shown in FIG. 2, the engaging mechanism 5 is disposed in an engaged position. The engaging portion 513 of the engaging mechanism 5 engages with the needle bar 16A at a position on the needle bar 16A that is higher than the needle holder 18. In other words, the engaging portion 513 engages with the needle bar 16A at a position in the up-down direction that is different from the position where the insertion portion 4 is inserted. Note that the diameter of the arc R2 of the engaging portion 513 of the engaging mechanism 5 (refer to FIG. 8) is substantially the same as the diameter of the needle bar 16A (refer to FIG. 13), and the central angle is approximately 180 degrees. Therefore, when the engaging mechanism 5 is disposed in an engaged position, the engaging portion 513 fits tightly against an area that accounts for half of the circumference of the needle bar 16A.

The recessed portion 55 is deeper than the recessed portion 54. Accordingly, when the protuberance 63 is engaged with the recessed portion 55, movement of the protuberance 63 from the recessed portion 55 toward the recessed portion 54 is restricted. Therefore, movement of the engaging lever 6 from the second position toward the first position is inhibited. The state in which the engaging mechanism 5 is in an engaged position is stable. The punch needles 9 that are affixed to the affixing portion 3D are held onto the needle bar 16A in a stable manner by the insertion portion 4 and the engaging mechanism 5. Furthermore, when the engaging lever 6 has moved to the second position, the cam 7 projects farther to the rear than the rear edge of the body portion 3C. The side 72A of the notch 72 of the cam 7 (refer to FIG. 13) is disposed above the needle holder 18. Therefore, downward movement of the needle mounting device 2 in relation to the needle bar 16A is restricted by the cam 7.

Figure 15:
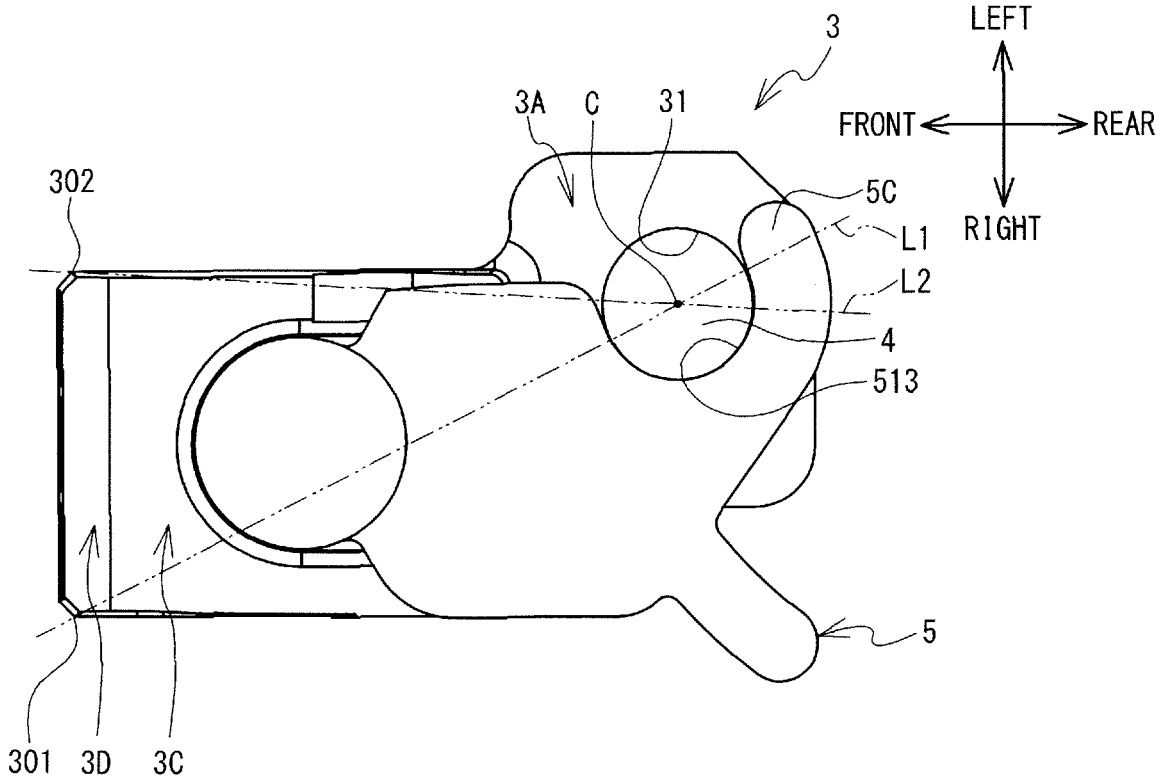
FIG. 15 is a plan view of the base portion and the engaging mechanism.

As shown in FIG. 15, in a state in which the engaging mechanism 5 is disposed in an engaged position, the affixing portion 3D of the base portion 3 of the needle mounting device 2 is set apart from the insertion portion 4 toward the front. Assume that, with the needle mounting device 2 being viewed from above, a virtual straight line L1 extends horizontally from a right edge 301 of the affixing portion 3D through a center C of the insertion portion 4, and a virtual straight line L2 extends horizontally from a left edge 302 of the affixing portion 3D through the center C of the insertion portion 4. In this case, both of the straight lines L1, L2 intersect with the extension portion 5C of the engaging mechanism 5 to the rear of the center C of the insertion portion 4. In other words, at least a portion of the extension portion 5C is located on the opposite side of the insertion portion 4 from the affixing portion 3D.

Disengaging Operation of the Needle Mounting Device 2

Figure 16:
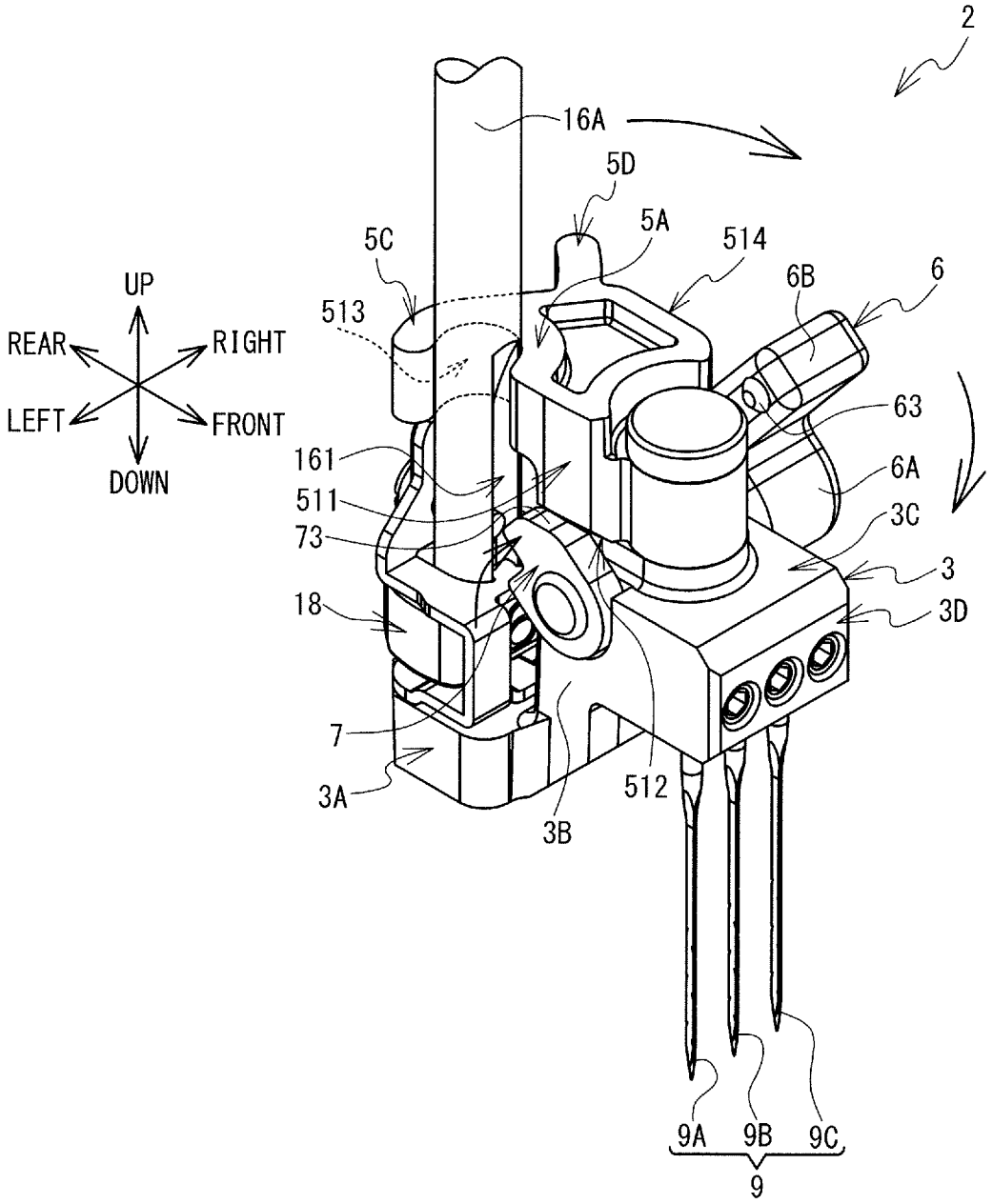
FIG. 16 is an oblique view of the needle mounting device (with the engaging lever between the first position and the second position).

In a state in which the needle mounting device 2 is mounted on the needle bar 16A (refer to FIG. 2), the engaging lever 6 is rotated from the second position toward the first position. The protuberance 63 on the engaging lever 6 shifts away from the recessed portions 54, 55 of the engaging mechanism 5. As shown in FIG. 16, the engaging lever 6 moves away from the engaging mechanism 5. The cam 7 rotates in accordance with the rotation of the engaging lever 6. The beveled portion 73 of the cam 7 moves upward. The beveled portion 73 comes into contact with the beveled portion 512 of the engaging mechanism 5 from below. When the cam 7 rotates farther, a force from the cam 7 acts on the engaging mechanism 5 in the rightward direction. The engaging portion 513 of the engaging mechanism 5 shifts away from the needle bar 16A. The engaging mechanism 5 rotates from an engaged position toward the disengaged position side.

Next, the right side face of the cam 7 comes into contact with the side face 511 of the engaging mechanism 5 from the left side. The portion of the side face 511 that is toward the front from the portion P (refer to FIG. 8) is curved. Accordingly, the contact between the right side face of the cam 7 and the portion of the side face 511 that is toward the front from the portion P causes the cam 7 to rotate farther. In accordance with the rotation of the cam 7, the force from the cam 7 acts even more on the engaging mechanism 5 in the rightward direction. The engaging mechanism 5 rotates farther toward the disengaged position side. The needle mounting device 2 is put into a state in which it can disengage from the needle bar 16A.

Main Operations and Effects of the Present Embodiment

In the needle mounting device 2, the insertion portion 4 is inserted into the mounting portion 161 of the needle bar 16A, and the insertion portion 4 is affixed to the needle bar 16A by the needle holder 18. The engaging mechanism 5 also engages the needle mounting device 2 with the needle bar 16A at a position on the needle bar 16A that is higher than the position where the insertion portion 4 is inserted. The needle mounting device 2 thus mounts on the needle bar 16A the punch needles 9 that are affixed to the affixing portion 3D. In this case, the needle mounting device 2 is able to hold the punch needles 9 against the needle bar 16A at a plurality of locations. Accordingly, the needle mounting device 2 is able to mount the punch needles 9 more securely on the needle bar 16A than would be the case if the punch needles 9 were held against the needle bar 16A at only a single location.

The needle mounting device 2 is provided with the engaging lever 6. In the process by which the engaging lever 6 rotates from the first position toward the second position, the protuberance 63 on the engaging lever 6 comes into contact with the recessed portion 54 of the engaging mechanism 5 from the right side. The protuberance 63 moves along the recessed portion 54 toward the recessed portion 55. When the engaging lever 6 comes into contact with the engaging mechanism 5 from the right side, it pushes the engaging mechanism 5 toward the left side, such that the engaging mechanism 5 rotates from a disengaged position toward the engaged position side. When the protuberance 63 is engaged with the recessed portion 55, the engaging mechanism 5 is disposed in an engaged position, and the engaging portion 513 is engaged with the needle bar 16A. In other words, by performing an operation that rotates the engaging lever 6 from the first position toward the second position, a user can rotate the engaging mechanism 5 from a disengaged position toward an engaged position on the engaged position side. Accordingly, by performing a simple operation on the needle mounting device 2, the user can easily mount the punch needles 9 on the needle bar 16A.

When the engaging lever 6 is in the second position, the extension portion 6B of the engaging lever 6 comes into contact with the side face 514 of the engaging mechanism 5. Therefore, movement of the engaging mechanism 5 from an engaged position toward a disengaged position is restricted. The engaging lever 6 is also provided with the protuberance 63. When the engaging lever 6 is in the second position, the protuberance 63 engages with the recessed portion 55 of the engaging mechanism 5. This configuration inhibits movement of the engaging lever 6 from the second position toward the first position. Thus, when the engaging mechanism 5 is engaged with the needle bar 16A, the needle mounting device 2 is able to prevent the engaging mechanism 5 from disengaging from the needle bar 16A.

In the process by which the engaging lever 6 rotates from the second position toward the first position, the beveled portion 73 of the cam 7 moves upward. The beveled portion 73 of the cam 7 comes into contact with the beveled portion 512 of the engaging mechanism 5 from below, and then the right side face of the cam 7 comes into contact with the side face 511 of the engaging mechanism 5 from the left side. As the cam 7 rotates, the beveled portion 73 of the cam 7 causes a force to act on the engaging mechanism 5 through the side face 511. The engaging portion 513 shifts away from the needle bar 16A. In other words, by performing an operation that rotates the engaging lever 6 from the second position toward the first position, the user can cause the engaging mechanism 5 to rotate from an engaged position toward a disengaged position on the disengaged position side. Accordingly, by performing a simple operation on the needle mounting device 2, the user can easily disengage the punch needles 9 from the needle bar 16A.

The plane S1, which is tangent to the portion of the side face 511 of the engaging mechanism 5 that is toward the front from the portion P, and the plane S2, which extends along the beveled portion 512 of the engaging mechanism 5, are oblique in relation to the left-right direction. In a case where the cam 7 rotates in accordance with the rotation of the engaging lever 6 from the second position toward the first position, the side face 511 and the beveled portion 512 move along the cam 7, and the engaging mechanism 5 rotates smoothly from an engaged position toward the disengaged position side. Therefore, in a case where the user rotates the engaging lever 6 in order to rotate the engaging mechanism 5 from an engaged position toward a disengaged position, the force that is required for the operation of rotating the engaging lever 6 can be reduced.

When the engaging lever 6 is disposed in the second position, a portion of the cam 7 projects farther to the rear than the rear edge of the body portion 3C of the base portion 3. In this case, the side 72A of the cam 7 faces downward toward the foundation portion 3A of the base portion 3. The needle holder 18 of the sewing machine 1 is held between the foundation portion 3A and the cam 7 from below and above, respectively. In other words, in relation to the needle mounting device 2, the position in which the needle holder 18 can be disposed in the up-down direction is limited to being between the foundation portion 3A and the side 72A of the cam 7. Accordingly, the user can easily determine the position in the up-down direction at which the needle mounting device 2 is mounted on the needle bar 16A. Furthermore, when the needle mounting device 2 is mounted on the needle bar 16A, the cam 7 is able to restrict the downward movement of the needle mounting device 2 in relation to the needle bar 16A.

The protuberance 38A on the body portion 3C of the base portion 3 fits into the recessed portion 53 of the engaging mechanism 5 from below. The rotation of the engaging mechanism 5 in relation to the body portion 3C is restricted to the angle range θ2 within which the protuberance 38A can move inside the recessed portion 53. Every position to which the engaging mechanism 5 moves within the angle range θ2 corresponds to one of an engaged position and a disengaged position. In this case, the user is able to limit the amount of rotation when moving the engaging mechanism 5 to a disengaged position prior to mounting the needle mounting device 2 on the needle bar 16A. Accordingly, because the task of switching the engaging mechanism 5 to a disengaged position can be simplified, the user is able to start the operation of engaging the engaging mechanism 5 with the needle bar 16A more quickly. Therefore, the user can engage the engaging mechanism 5 with the needle bar 16A in less time. Note that by restricting the movement of the protuberance 38A within the recessed portion 53 and thereby restricting the rotation of the engaging mechanism 5 to within the angle range θ2, the needle mounting device 2 is able to appropriately inhibit the engaging mechanism 5 from rotating beyond the angle range θ2.

When the engaging lever 6 is disposed in the second position, the extension portion 6B extends vertically upward from the cylindrical portion 6A. The engaging of the protuberance 63 on the engaging lever 6 with the recessed portion 55 of the engaging mechanism 5 makes it possible for the extension portion 6B to restrict the engaging mechanism 5 from rotating toward the disengaged position side as far as the maximum disengagement position. On the other hand, when the engaging lever 6 is disposed in the first position, a portion of the cam 7 projects farther upward than the top face of the projecting portion 38 of the body portion 3C of the base portion 3. The cam 7 comes into contact with the side face 511 of the engaging mechanism 5 from the left side, thereby restricting the engaging mechanism 5 from rotating toward the engaged position side as far as the maximum engagement position. The needle mounting device 2 is thus able to use the engaging lever 6 and the cam 7 to restrict the rotation of the engaging mechanism 5. Note that the engaging lever 6 has the intrinsic function of causing the engaging mechanism 5 to rotate as far as an engaged position. Similarly, the cam 7 has the intrinsic function of causing the engaging portion 513 of the engaging mechanism 5 to shift away from the needle bar 16A and causing the engaging mechanism 5 to rotate toward the disengaged position side. Therefore, because the needle mounting device 2 is able to restrict the rotation of the engaging mechanism 5 by utilizing the respective intrinsic functions of the engaging lever 6 and cam 7, the configuration of the needle mounting device 2 can be simplified. Furthermore, while the protuberance 38A and the recessed portion 53 restrict the rotation of the engaging mechanism 5 to within the angle range θ2, the needle mounting device 2 is able to utilize the engaging lever 6 and the cam 7 to restrict the rotation of the engaging mechanism 5 to a range that is narrower than the angle range θ2.

In the needle mounting device 2, the orientation of the flat face 41 of the insertion portion 4 with respect to the base portion 3 (the foundation portion 3A, the connecting portion 3B, the body portion 3C, the affixing portion 3D) can be adjusted by the set screw 81. Note that in a case where the punch needles 9 have been mounted on the needle bar 16A by the needle mounting device 2, the position of the punch needles 9 in relation to the needle bar 16A is determined by the orientation of the affixing portion 3D with respect to the flat face 41 of the insertion portion 4. Therefore, the user is able to adjust the position of the punch needles 9 that are mounted on the needle bar 16A by using the set screw 81 to adjust the orientation of the flat face 41 with respect to the affixing portion 3D. Moreover, once the user has used the set screw 81 to adjust the position of the punch needles 9, the user does not need to adjust the position again, even if the needle mounting device 2 is removed from the sewing machine 1 and then remounted on the sewing machine 1.

When the engaging mechanism 5 is disposed in an engaged position, at least a portion of the extension portion 5C is disposed on the opposite side of the insertion portion 4 from the affixing portion 3D. In this case, the force that acts on the affixing portion 3D through the punch needles 9 during needle punching can be appropriately supported by the engaging portion 513. Accordingly, the needle mounting device 2 is able to inhibit the engaging mechanism 5 from shifting away from the needle bar 16A during needle punching.

Modified Examples

The present disclosure is not limited to the embodiment that is described above, and various types of modifications can be made. The shape of the part of the needle bar 16A into which the insertion portion 4 of the needle mounting device 2 is inserted may also be a hole, and it may also be a notch that is provided in the lower end of the needle bar 16A. The upper end of the insertion portion 4 may also extend farther upward than the top edge of the engaging mechanism 5. The position on the needle bar 16A where the engaging mechanism 5 engages with the needle bar 16A may also partially overlap, in the up-down direction, the position on the needle bar 16A where the insertion portion 4 is inserted into the needle bar 16A. As long as the position where the engaging mechanism 5 engages with the needle bar 16A is different from the position where the insertion portion 4 is inserted into the needle bar 16A, the needle mounting device 2 is able to mount the punch needles 9 securely on the needle bar 16A. The central angle of the arc R2, which encompasses the engaging portion 513 of the engaging mechanism 5, may also be greater than 180 degrees. In that case, the engaging portion 513 may engage with the needle bar 16A in accordance with the movement of the engaging mechanism 5 toward an engaged position.

The engaging mechanism 5 may also be affixed to the base portion 3 in an engaged position, such that it cannot rotate. In that case, the user may, for example, first bring the lower end of the needle bar 16A into contact with the engaging portion 513 of the engaging mechanism 5, then insert the insertion portion 4 into the mounting portion 161 of the needle bar 16A by moving the needle mounting device 2 vertically upward in relation to the needle bar 16A. In that case, the engaging portion 513 of the engaging mechanism 5 may also have a shape that covers the entire circumference of the needle bar 16A. The insertion portion 4 may also be affixed to the foundation portion 3A of the base portion 3 such that it cannot rotate. Instead, the affixing portion 3D may be able to rotate in relation to the foundation portion 3A, the connecting portion 3B, and the body portion 3C. The user may adjust the orientation of the affixing portion 3D in relation to the foundation portion 3A by rotating the affixing portion 3D.

It is also acceptable for the needle mounting device 2 not to have the engaging lever 6 and the cam 7. For example, the user may engage the engaging mechanism 5 with the needle bar 16A by gripping the extension portion 5D of the engaging mechanism 5 and rotating the engaging mechanism 5 from a disengaged position toward the engaged position side. The user may also, for example, disengage the engaging mechanism 5 from the needle bar 16A by gripping the extension portion 5D of the engaging mechanism 5 and rotating the engaging mechanism 5 from an engaged position toward the disengaged position side. In that case, it is also acceptable for the side face 511 of the engaging mechanism 5 not to be curved. It is also acceptable for the engaging mechanism 5 not to include the beveled portion 512.

One of a curved portion and a beveled portion may also be provided in the portion of the upper edge of the cam 7 that comes into contact with the engaging mechanism 5 as the cam 7 rotates. In that case, even if the side face 511 of the engaging mechanism 5 is not curved and the beveled portion 512 is not provided, it is possible for the cam 7 to cause the engaging mechanism 5 to rotate from an engaged position toward the disengaged position side.

The side 72A of the cam 7 may also come into contact with the needle holder 18 from above when the engaging lever 6 moves from the first position to the second position. The cam 7 and the foundation portion 3A of the base portion 3 may hold the needle holder 18 from below and above, respectively.

The recessed portion 53 and the protuberance 38A make it possible for the engaging mechanism 5 to rotate within the angle range θ2. Every position to which the engaging mechanism 5 moves within the angle range θ2 is one of an engaged position and a disengaged position. Here, an engaged position and the maximum engagement position may be congruent. In other words, in a state in which the engaging mechanism 5 is engaged with the needle bar 16A, the protuberance 38A may be in contact with the right edge 53B of the recessed portion 53. It is also acceptable for the engaging mechanism 5 not to be provided with the recessed portions 54, 55 and the extension portion 5D. In that case, the rotation of the engaging mechanism 5 from an engaged position toward the disengaged position side may be restricted by the force with which the engaging portion 513 engages with the needle bar 16A. It is also acceptable for the recessed portion 53 and the protuberance 38A not to be provided. The engaging mechanism 5 may also be able to rotate 360 degrees.

In a state in which the needle mounting device 2 is mounted on the needle bar 16A, the positions of the needle bar 16A and the affixing portion 3D of the base portion 3 may also be congruent in the left-right direction. In other words, the affixing portion 3D, the insertion portion 4, and the engaging portion 513 of the engaging mechanism 5, which is disposed in an engaged position, may be arrayed along a single straight line extending in the front-rear direction. In that case, the engaging portion 513 may also engage with the front side of the needle bar 16A.

In a case where the protuberance 63 of the engaging lever 6 has disengaged from the recessed portion 55 of the engaging mechanism 5, one of the projecting portion 51A and the extension portion 5D of the engaging mechanism 5 may come into contact with the extension portion 6B from the rear side, thereby restricting the engaging mechanism 5 from rotating toward the disengaged position side as far as the maximum disengagement position. In other words, the rotation of the engaging mechanism 5 toward the disengaged position side may be restricted by the engaging lever 6 before the engaging mechanism 5 reaches the maximum disengagement position. It is also acceptable for the protuberance 38A of the base portion 3 and the recessed portion 53 of the engaging mechanism 5 not to restrict the rotation of the engaging mechanism 5. In other words, the rotation of the engaging mechanism 5 toward the disengaged position side may be restricted solely by the engaging lever 6. Similarly, the rotation of the engaging mechanism 5 toward the engaged position side may be restricted solely by the cam 7.

It is also acceptable for the needles that are affixed to the affixing portion 3D not to be the punch needles 9. For example, instead of the punch needles 9, sewing needles may also be affixed to the affixing portion 3D. Cutting needles that are provided with cutting edges on their lower ends and that cut a workpiece such as a cloth or the like may also be affixed to the affixing portion 3D instead of the punch needles 9.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A needle mounting device for mounting a punch needle for needle punching on a needle bar of a sewing machine, the needle mounting device comprising:

a base portion that includes a foundation portion and a body portion;

an insertion portion supported by the foundation portion, extending in an extension direction from the foundation portion, and configured to be inserted into a mounting portion provided in the needle bar for mounting a sewing needle;

a rotation axis that extends in the extension direction;

an engaging mechanism capable of engaging with the needle bar at a different position from the insertion portion in the extension direction, the engaging mechanism including a U-shaped engaging portion along an outer surface of the needle bar, the engaging mechanism being supported by the body portion so as to be rotatable about the rotation axis between an engaged position where the engaging portion is engaged with the needle bar and a disengaged position where the engaging portion is disengaged from the needle bar; and an affixing portion configured to affix the punch needle.

2. The needle mounting device according to claim 1, further comprising:

an engaging lever capable of rotating between a first position and a second position about a direction intersecting the extension direction, wherein the engaging lever is configured to come into contact with the engaging mechanism and rotate the engaging mechanism about the rotation axis from the disengaged position toward the engaged position when the engaging lever rotates from the first position to the second position.

3. The needle mounting device according to claim 1, further comprising:

an engaging lever capable of rotating between a first position and a second position about a direction that intersects the extension direction, wherein the second position is such that the engaging lever comes in contact with the engaging mechanism and the engaging lever restricts the rotation of the engaging mechanism from the engaged position toward the disengaged position when the engaging mechanism is in the engaged position, and, the first position is such that the engaging lever does not come in contact with the engaging mechanism and does not restrict the rotation of the engaging mechanism from the engaged position toward the disengaged position.

4. The needle mounting device according to claim 3, wherein the engaging lever includes a first protruding portion, the engaging mechanism includes a first recessed portion, and the first protruding portion is engaged with the first recessed portion when the engaging lever is in the second position.

5. The needle mounting device according to claim 3, further comprising:

a cam configured to rotate in conjunction with a rotation of the engaging lever, wherein the cam is configured to come into contact with the engaging mechanism and rotate the engaging mechanism from the engaged position toward the disengaged position when the engaging lever rotates from the second position to the first position.

6. The needle mounting device according to claim 5, wherein a face of the engaging mechanism adjoining a portion of the engaging mechanism configured to come into contact with the cam is oriented obliquely to an axis of rotation of the cam.

7. The needle mounting device according to claim 3, further comprising:

a cam configured to rotate in conjunction with a rotation of the engaging lever, wherein at least a portion of the foundation portion and a portion of the cam are disposed opposite one another in the extension direction when the engaging lever has moved to the second position.

8. The needle mounting device according to claim 3, further comprising:

a restricting portion restricting the rotation of the engaging mechanism, wherein the engaging mechanism is configured to rotate within a specified angle range, the specified angle range including the engaged position and the disengaged position, and the restricting portion restricts the rotation of the engaging mechanism to within the specified angle range.

9. The needle mounting device according to claim 8, wherein the restricting portion includes a second protruding portion provided on one of the engaging mechanism and the body portion, and a second recessed portion provided on the one of the engaging mechanism and the body portion on which the second protruding portion is not provided and with which the second protruding portion engages.

10. The needle mounting device according to claim 3, further comprising:

a cam configured to rotate in conjunction with a rotation of the engaging lever, wherein the engaging mechanism is configured to rotate within a specified angle range, the specified angle range including the engaged position and the disengaged position, the cam, in a state in which the engaging lever has moved to the first position, restricts a rotation of the engaging mechanism toward an engaged position side of the specified angle range, and the engaging lever, in a state in which the engaging lever has moved to the second position, restricts a rotation of the engaging mechanism toward a disengaged position side of the specified angle range.

11. The needle mounting device according to claim 10, further comprising:

a restricting portion restricting the rotation of the engaging mechanism to within the angle range, wherein the restricting portion includes a second protruding portion provided on one of the engaging mechanism and the body portion, and a second recessed portion provided on the one of the engaging mechanism and the body portion on which the second protruding portion is not provided and with which the second protruding portion engages.

12. The needle mounting device according to claim 1, further comprising:

an adjustment portion, wherein the foundation portion includes a hole extending in the extension direction, a part of the insertion portion is rotatably inserted in the hole about the extension direction, the insertion portion includes, on a portion of a circumferential face of the insertion portion, a flat portion formed along a plane parallel to the extension direction, and the adjustment portion adjusts an orientation of the flat portion in relation to the affixing portion by restricting the rotation of the insertion portion when the adjustment portion comes into contact with the insertion portion.

13. The needle mounting device according to claim 1, wherein the affixing portion is set apart from the insertion portion in an orthogonal direction orthogonal to the extension direction, and at least a portion of the engaging mechanism is disposed on the opposite side of the insertion portion from the affixing portion in the orthogonal direction.

14. A sewing machine, comprising:

a needle bar; and a needle mounting device for mounting a punch needle for needle punching on the needle bar, wherein the needle mounting device includes a base portion that includes a foundation portion and a body portion;

an insertion portion supported by the foundation portion, extending in an extension direction from the foundation portion, and configured to be inserted into a mounting portion provided in the needle bar for mounting a sewing needle;

a rotation axis that extends in the extension direction;

an engaging mechanism capable of engaging with the needle bar at a different position from the insertion portion in the extension direction, the engaging mechanism including a U-shaped engaging portion along an outer surface of the needle bar, the engaging mechanism being supported by the body portion so as to be rotatable about the rotation axis between an engaged position where the engaging portion is engaged with the needle bar and a disengaged position where the engaging portion is disengaged from the needle bar; and an affixing portion configured to affix the punch needle.

* * * * *